United States Patent [19]

Kanzaka

[11] Patent Number: 4,481,696

[45] **Date of Patent: * Nov. 13, 1984**

[54] SNAP-FIT BUTTON

[75] Inventor: Yoshihiro Kanzaka, Nyuzen, Japan

[73] Assignee: Yoshida Kogyo K.K., Tokyo, Japan

[ * ] Notice: The portion of the term of this patent subsequent to Jun. 14, 2000 has been disclaimed.

[21] Appl. No.: 354,670

[22] Filed: Mar. 4, 1982

[30] Foreign Application Priority Data

Mar. 13, 1981 [JP] Japan ..... 56-35955[U]

[51] Int. Cl.[3] ..... A44B 1/12; A44B 1/38

[52] U.S. Cl. ..... 24/113 R; 24/92; 24/108; 24/90 E

[58] Field of Search ..... 24/90 C, 90 A, 101 R, 24/104, 107, 108, 216, 217, 219, 113 R, 101 R, 108, 90 E, 90 C

[56] References Cited

U.S. PATENT DOCUMENTS

| | | | |
|---|---|---|---|
| 1,942,171 | 1/1934 | Janes | 24/208 R |
| 2,640,238 | 6/1953 | Schuhr | 24/113 R |
| 2,835,948 | 5/1958 | Blake | 24/108 |
| 2,996,777 | 8/1961 | Mishkin | 24/104 |
| 3,545,798 | 12/1970 | Swett | 24/216 |
| 4,387,488 | 6/1983 | Kanzaka | 24/113 R |

FOREIGN PATENT DOCUMENTS

| | | | |
|---|---|---|---|
| 49119625 | 6/1976 | Japan . | |
| 385215 | 8/1932 | United Kingdom | 24/106 |

*Primary Examiner*—Gene Mancene
*Assistant Examiner*—Kris R. Schulze
*Attorney, Agent, or Firm*—Bucknam and Archer

[57] ABSTRACT

A button includes a button body having a centrally holed boss, and a fastener having a shank adapted to fit forcibly into an axial hole in the boss. The shank has a plurality of axially extending ridges spaced angularly at equal intervals for maintaining the shank in accurate axial alignment with the boss hole.

9 Claims, 9 Drawing Figures

SNAP-FIT BUTTON

BACKGROUND OF THE INVENTION

1. Field of the Invention

The present invention relates to a button having a button body with or without a covering member thereon, and a fastener which are adapted to be mounted with a snap fit on a piece of cloth.

2. Prior Art

U.S. Pat. No. 2,996,777 patented Aug. 22, 1961 and Japanese Laid-Open Utility Model Publication No. 51-46501 published Apr. 6, 1976 disclose buttons which comprise a button body including a head and a centrally holed cylindrical boss, and a fastener having a base and a shank inserted forcibly into the hole in the boss to secure the button to a piece of cloth. The prior art buttons have a drawback in that when the shank is forced into a hole in the boss, the shank is liable to be tilted with respect the axis of the boss hole, developing a clearance between the base and the piece of cloth. With the shank thus tilted, the button wobbles on the piece of cloth, and sometimes is displaced off the piece of cloth.

SUMMARY OF THE INVENTION

A button includes a button body having a head and a boss extending from the head and having a hole therein, and a fastener having a base and a shank extending from the base and adapted to be fitted forcibly into the hole in the boss. The shank has a plurality of axially extending ridges spaced angularly at equal intervals. When the shank is forced into the boss hole, the axial ridges contact with the inner peripheral wall defining the boss hole in parallel relation to the axis of the boss hole, enabling the shank to fit into the hole in accurate axial alignment with the latter.

It is an object of the present invention to provide a button which can be mounted stably on a piece of cloth without wobbling movement.

Another object of the invention is to provide a button which comprises a fastener including a shank having means for enabling the shank to fit forcibly into a hole in a button body in axial alignment with the hole to thereby sandwich the piece of cloth between the button body and the fastener.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
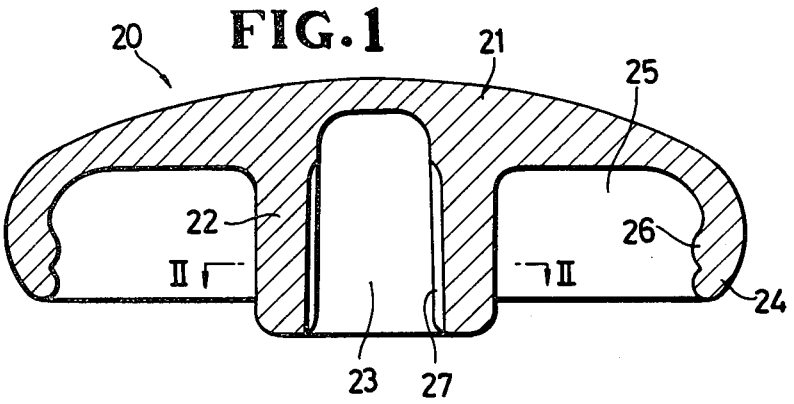
FIG. 1 is a vertical cross-sectional view of a button body according to the present invention.
Figure 2:
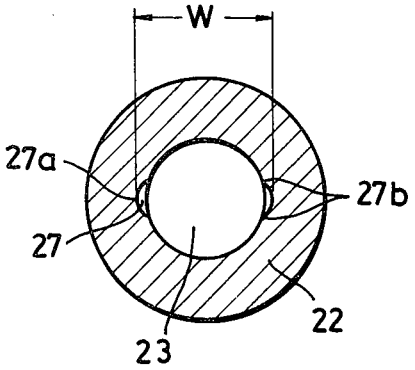
FIG. 2 is a cross-sectional view taken along the line II—II of FIG. 1.

As shown in FIG. 1, a button body 20 which is made of metal or preferably synthetic resin comprises a circular domed head 21 having a cylindrical central boss 22 or stem with an axial hole 23 and a reentrant peripheral flange 24 extending annularly in surrounding relation to the central boss 22 with an annular space 25 therebetween. The peripheral flange 24 has an annular projection 26 extending therearound and projecting into the annular space 25 toward the boss 22 for a purpose described below. The boss 22 has a pair of diametrically opposite axial slots 27 as shown in FIGS. 1 and 2, each of the slots 27 opening into the hole 23 and extending axially substantially the full length of the boss 22. Each slot 27 is defined by an arcuate wall having a bottom 27*a* and a pair of upper edges 27*b*, the bottoms of the diametrically opposite slots 27,27 being spaced by a distance W as shown in FIG. 2.

Figure 3:
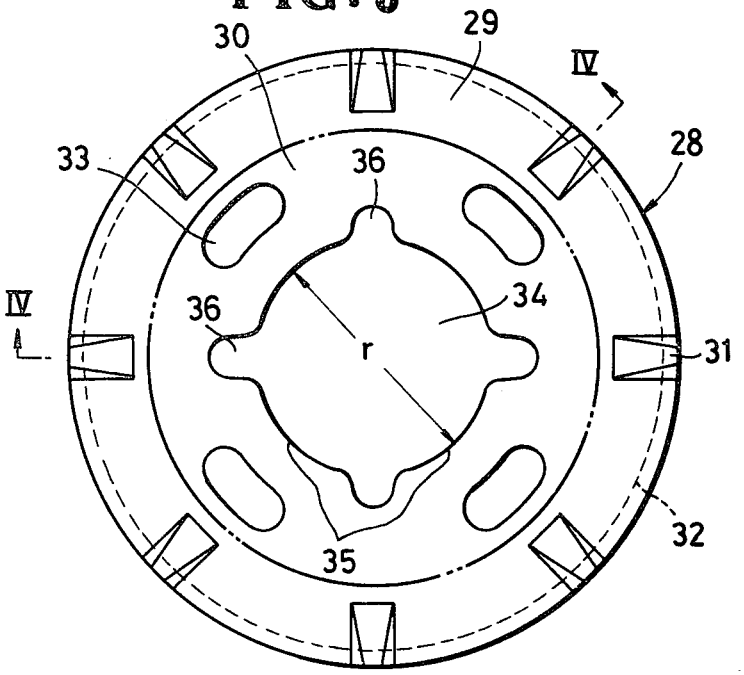
FIG. 3 is a plan view of a retainer washer according to the present invention.
Figure 4:
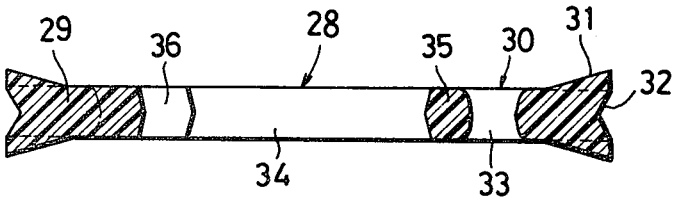
FIG. 4 is a cross-sectional view taken along the line IV—IV of FIG. 3.

A circular retainer washer 28 shown in FIG. 3 is made of synthetic resin, and it comprises an annular rib or ring 29 and an inner web 30 (shown as being defined by phantom lines in FIG. 3) extending radially inwardly from the annular rib 29 and integral therewith. Although the annular rib 29 and the inner web 30 have the same thickness in the illustrated embodiment, the inner web 30 is preferably thinner than the annular rib 29. The annular rib 29 has a plurality of angularly spaced teeth 31 along an outer peripheral edge on each of opposite sides thereof. The annular rib 29 has in its outer periphery a circumferential groove 32. The inner web 30 includes a plurality of angularly spaced slots 33 located adjacent to the annular rib 29 so that the inner web 30 is more flexible than the annular rib 29. The inner web 30 includes a plurality of radial tongues 35 that have interrupted inner edges jointly defining a substantially circular opening 34, there being a plurality of radial notches 36 each between adjacent ones of the tongues 35. The opening 34 has a maximum diameter r (FIG. 3) slightly smaller than the outer diameter of the boss 22.

Figure 5:
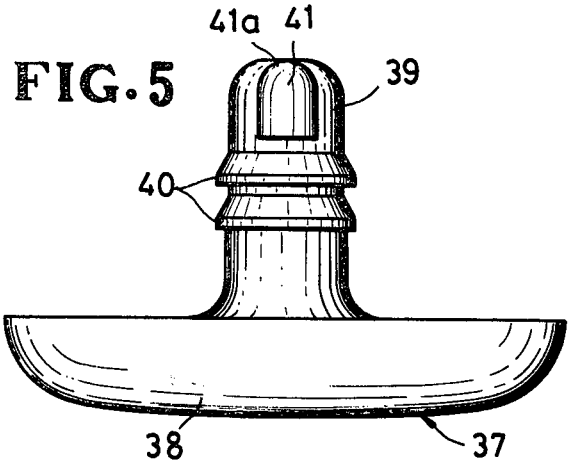
FIG. 5 is a front elevational view of a fastener according to the present invention.
Figure 6:
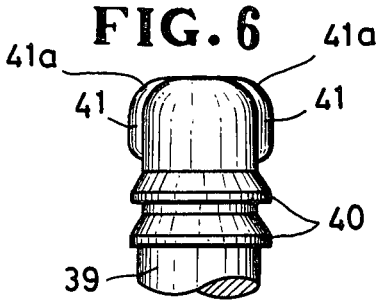
FIG. 6 is a fragmentary side elevational view of the fastener of FIG. 5.
Figure 7:
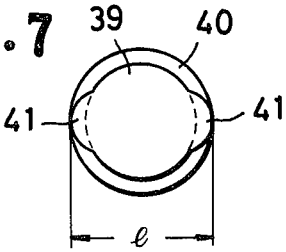
FIG. 7 is a plan view of the fastener shown in FIG. 6.

As shown in FIG. 5, a fastener 37 which is made of metal or preferably synthetic resin includes a circular base 38 and a central shank 39 projecting therefrom. The shank 39 has a maximum diameter substantially equal to or slightly smaller than the diameter of the opening 34 in the retainer washer 28. The shank 39 has a pair of spaced annual locking projections 40 disposed substantially centrally thereof and extending therearound in tandem relation. Each of the locking projections 40 has a peripheral surface tapered toward the distal end of the shank 39. The shank 39 further has on its outer periphery a pair of diametrically opposite axial ridges 41,41 each extending axially from the distal end of the shank 39 toward the head 38 and terminating short of one of the locking projections 40,40. Each of the axial ridges 41,41 has a streamlined nose 41*a*, merging into the distal end of the shank 39 for smooth introduction of the latter into the hole 23 in the boss 22. As shown in FIG. 7, the ridges 41,41 have a substantially segmental shape in transverse cross section having an apex touching internally a circle having a diameter l which is greater than the diameter of the boss hole 23. The annular locking projections 40,40 have an outside diameter substantially equal to the diameter l of the circle and slightly smaller than the distance W between the bottoms 27*a*,27*a* of the opposite slots 27,27.

Figure 8:
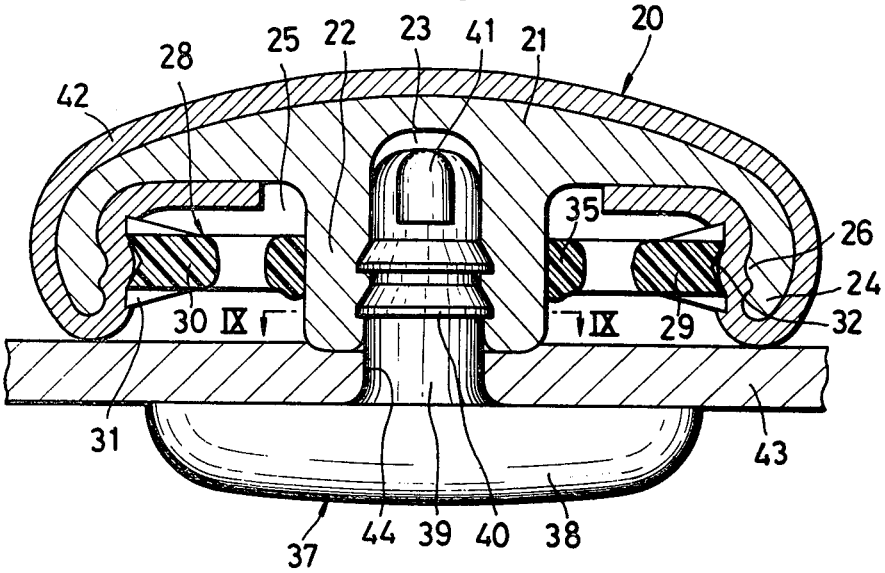
FIG. 8 is a vertical cross-sectional view of a covered button of the present invention, comprising the button body of FIG. 1, the retainer washer of FIG. 3, and the fastener of FIG. 5.

For assembly, the domed head 21 is wrapped by a covering member 42 (FIG. 8) made of a flexible material such as fabric, synthetic resin film or the like, with its marginal edge portion being tucked into the space 25 around the peripheral flange 24 of the domed head 21. Then, the retainer washer 28 is fitted into the button body 20 so that the inner web 30 is forcibly fitted over the boss 22 with the edges flexing resiliently against the boss 22 and the grooved outer periphery of the retainer washer 28 is snapped over the annular projection 26 of the domed head 21 with the flexible covering member 42 firmly gripped therebetween. The portion of the covering member 43 which is inside the domed head 21 is retained by the teeth 31 against slipping out.

Figure 9:
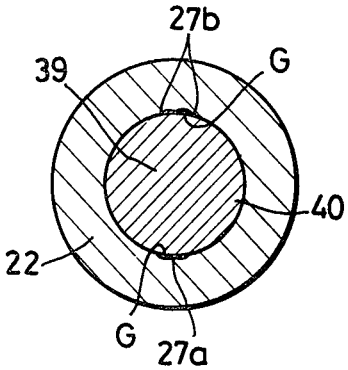
FIG. 9 is a cross-sectional view taken along the line IX—IX of FIG. 8.

The shank 39 of the fastener 31 is inserted through a preformed aperture 44 in a piece of cloth 43 to which a covered button is to be attached, and then the shank 39 is fitted forcibly into the hole 23 in the boss 22 until the cloth piece 43 is sandwiched between the base 38 and the domed head 21. During that time, the axial ridges 41,41 continuously contact with the inner peripheral wall defining the boss hole 23 along lines extending parallel to, or practically along the surfaces extending coaxially with, the axis of the boss hole 23. This self-aligning function of the ridges 41,41 enables the shank 39 to fit into the boss hole 23 in accurate axial alignment with the latter even when the shank 39 is initially inserted into the boss hole 23 along a line tilted with respect to the axis of the boss hole 23. The annular locking projections 40,40 bite into the inner peripheral wall defining the hole 23, preventing the button 20 from being separated from the fastener 37. With the streamlined noses 41*a*,41*a* of the respective axial ridges 41,41, the shank 39 can be introduced into the boss hole 23 smoothly. The slots 26 in the boss 22 allow air to escape out of the hole 23, so that the shank 39 can be pushed into the hole 23 with a relatively small force and no cracks will be developed in the button body 21 during the forced insertion of the shank 39. More specifically, as the shank 39 is inserted forcibly into the boss hole 23, the tapered peripheral surface of each annular locking projection 40 deforms the slots 27 in the boss 22 in such a manner that the slots 27 are expanded radially outwardly of the hole 23, first at the respective upper edges 27*b*, and then at the respective bottom surfaces 27*a*, whereby two pairs of narrow vent holes G are provided between the peripheral surface of the locking projection 40 and the respective slots 57 as shown in FIG. 9. Rather than providing the boss 22 with the slots 27, the shank 39 may have means for allowing air to escape out of the hole 23 on assemblage of the fastener 37 with the buttom body 20. The means may comprise at least one groove (not shown) extending axially in the shank 39 across the locking projections 40,40, or interrupted portions of the locking projections 40,40, which are partly cut away so as to provide at least on groove (not shown) extending axially across the locking projections 40,40.

From the foregoing description of one embodiment, the artisan will appreciate that the invention is generally applicable to a button comprising a button body 20, as in the FIG. 2 embodiment, including a head 21 and a central boss 22 projecting from the head 21 and having a hole 23 therein; and a fastener 37, as in the FIG. 5 embodiment, including a base 37 and a shank 39 projecting from the base 38 and adapted to fit forcibly into the hole 23 in the boss 22. The shank 39 has on its outer periphery a plurality of axially extending ridges 41,41 spaced angularly at equal intervals. The shank 39 further has at least one annular locking projection 40 extending therearound. The axial ridges 41,41 extend from the distal end of the shank 39 toward the head 38 and terminate short of the annular rib 40. Each of the axial ridges 41,41 has a streamlined nose 41*a* merged with the distal end of the shank 39 for easy introduction of the shank 39 into the boss hole 23. When the shank 39 is forcibly fitted into the boss hole 23, the axial ridges 41,41 serve as a self-aligning means for enabling the shank 39 to fit into the boss hole 23 in accurate axial alignment with the axis of the bore hole 23. One of the boss 22 of the button body 20 and the shank 39 of the fastener 37 has means for allowing air to escape from the hole 23 in the boss 22 when the shank 39 is forced into the hole 23. The means comprise at least one slot 24 in the boss 23 opening into the hole 23. Alternatively, the means comprise at least one groove (not shown) extending axially in the shank 39 substantially over the full length thereof. As a further alternative, the annular locking projection 40 may be partly cut out so as to provide an axial groove.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a piece of cloth having a preformed aperture, comprising:

(a) a button body including a domed head and a central boss projecting from said domed head and having a hole therein, said central boss having a cylindrical outer surface and a cylindrical bore having a continuous circumferential wall and closed at its outer end, said domed head having a peripheral flange surrounding said central boss in shaped relation, said central boss having a plurality of axially extending slots spaced angularly at equal intervals;

(b) a retainer washer of synthetic resin adapted to be mounted on said boss resiliently with a force fit and having an outer periphery adapted to coact with said peripheral flange of the domed head in gripping an edge portion of a flexible covering member for extending over said domed head and around said peripheral flange;

(c) a fastener having a base and a central shank projecting from said base and adapted to fit forcibly into said hole in the central boss through the aperture in the piece of cloth to sandwich the piece of cloth between said base and said button body, said shank having on its outer periphery a plurality of axially extending ridges spaced angularly at intervals corresponding to said slots on the central boss, and disposed for respective locking engagement therewith;

(d) said peripheral flange of said domed head having an annular projection extending therearound and projecting toward said boss; and (e) said retainer washer having a peripheral groove extending therearound and adapted to be snapped over said annular projection for receiving partly the edge portion of the covering member.

2. A button according to claim 1, said ridges extending from the distal end of said shank toward said base.

3. A button according to claim 1, said shank further having at least one annular locking projection extending therearound.

4. A button according to claim 2, said ridges extending from the distal end of said shank and terminating short of said annular locking projection.

5. A button according to claim 1, each said ridge having a streamlined nose merged with the distal end of said shank.

6. A button according to claim 1, said ridges having a substantially segmental shape in transverse cross section.

7. A button according to claim 6, said ridges having apices touching internally a circle having a diameter greater than the diameter of said hole in said boss.

8. A button according to claim 3, said annular locking projection having a diameter greater than the diameter of said hole in said boss.

9. A button for attachment to a piece of cloth having a preformed aperture, comprising:

(a) a button body including a domed head, a central boss projecting from said domed head and having an axial blind hole therein, said central boss having a cylindrical outer surface and a cylindrical bore having a continuous circumferential wall and closed at its outer end, said domed head having a peripheral flange surrounding said central boss in spaced relation, said central boss having at least one axially extending slot opening into said blind hole;

(b) a retainer washer of synthetic resin adapted to be mounted on said boss resiliently with a force fit and having an outer periphery adapted to coact with said peripheral flange of said domed head in gripping an edge portion of a flexible covering member for extending over said domed head and around said peripheral flange;

(c) a fastener having a base and a central shank projecting from said base and adapted to fit forcibly into said blind hole in said central boss through the aperture in the piece of cloth to sandwich the piece of cloth between said base and said button body, said shank having on its outer periphery a plurality of axially extending ridges spaced angularly at intervals, said ridges having apices touching internally an imaginary circle having a radius greater than the radius of said blind hole, said shank further having at least one annular locking projection extending therearound;

(d) said annular locking projection having a radius substantially equal to the radius of said imaginary circle and slightly smaller than the distance between the axis of said blind hole and a bottom of said slot; and (e) said radius of said annular locking projection being greater than the radius of curvature of said slot.

* * * * *